US006533153B2

(12) United States Patent
Huang

(10) Patent No.: US 6,533,153 B2
(45) Date of Patent: Mar. 18, 2003

(54) TAPE DISPENSER

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 0 days.

(21) Appl. No.: 09/873,996

(22) Filed: Jun. 6, 2001

(65) Prior Publication Data

US 2002/0185511 A1 Dec. 12, 2002

(51) Int. Cl.[7] ..... B26F 3/02
(52) U.S. Cl. ..... 225/47; 225/77; 242/598.2
(58) Field of Search ..... 225/46, 47, 42, 225/45, 77, 35, 6; 242/598, 598.3, 598.2, 599, 598.5; D19/67, 69

(56) References Cited

U.S. PATENT DOCUMENTS 3,489,324 A * 1/1970 Stohl ..... 225/45
5,228,612 A * 7/1993 Kuo et al. ..... 225/47
6,311,923 B1 * 11/2001 Tsai ..... 242/598.5
6,371,403 B1 * 4/2002 Shen ..... 242/598.2

* cited by examiner

*Primary Examiner*—Hwei-Siu Payer
(74) *Attorney, Agent, or Firm*—Browdy and Neimark, P.L.L.C.

(57) ABSTRACT

A tape dispenser comprises a seat body and a tape reel seat. The seat body is provided at the front end with a tape cutter, in the top with a long groove and a joining hole neighbored at one side of the groove. The seat body is further provided at the bottom with a bottom seat having a greater weight to stabilize the bottom seat on a surface. The tape reel seat is provided at one end with an insertion portion, and at other end with a mounting portion for mounting a tape roll. The insertion portion is inserted into the joining hole of the seat body such that the tape reel seat is removably confined on the seat body.

14 Claims, 4 Drawing Sheets

TAPE DISPENSER

FIELD OF THE INVENTION

The present invention relates generally to a tape dispenser, and more particularly to a tape dispenser with a removable tape reel seat.

BACKGROUND OF THE INVENTION

As shown in FIG. 1, a prior art tape dispenser comprises a seat body 30 which is provided at the front end with a tape cutter 31, and in the top with a long groove 32. The seat body 30 is further provided on each of the two side walls of the groove 32 with an insertion slot 33 respectively. These two insertion slots 33 extend downwards for a predetermined distance from the top of the two walls such that they are curved toward the front side of the seat body 30, and that they have an opening at the top side of the seat body 30. A tape reel seat 34 is provided with a tape roll 40 mounted thereon. The tape reel seat 34 is provided at the center of two sides with a shaft pillar 341. The two shaft pillars 341 of the tape reel seat 34 are slid into the curved portion from the opening of the insertion slots 33, thereby enabling the tape reel seat 34 to be rotatably mounted on the seat body 30.

The tape reel seat 34 is retained by means of the curved shape of the two insertion slots 33. Such a retaining force provided by the retaining mechanism is relatively weak. In the event that the seat body 30 is tilted or put upside down, the tape reel seat 34 is apt to escape unexpectedly, thereby resulting in separation or loss of the tape reel seat 34. As a result, the prior art tape dispenser is useless.

SUMMARY OF THE INVENTION

The primary objective of the present invention is to provide a tape dispenser with a tape reel seat which has a stronger retaining ability.

The present invention comprises a seat body having a tape cutter and a long groove located in the top side. A joining hole is disposed in the top side of the seat body and neighbored at one side of the groove. The bottom side of the seat body has a bottom. seat with a greater weight. A tape reel seat is provided at one end with an insertion portion, and at other end with a mounting portion for mounting a tape roll. The insertion portion of the tape reel seat is inserted into the joining hole to enable the tape reel seat to be removably confined on the seat body.

DETAILED DESCRIPTION OF THE INVENTION

Figure 1:
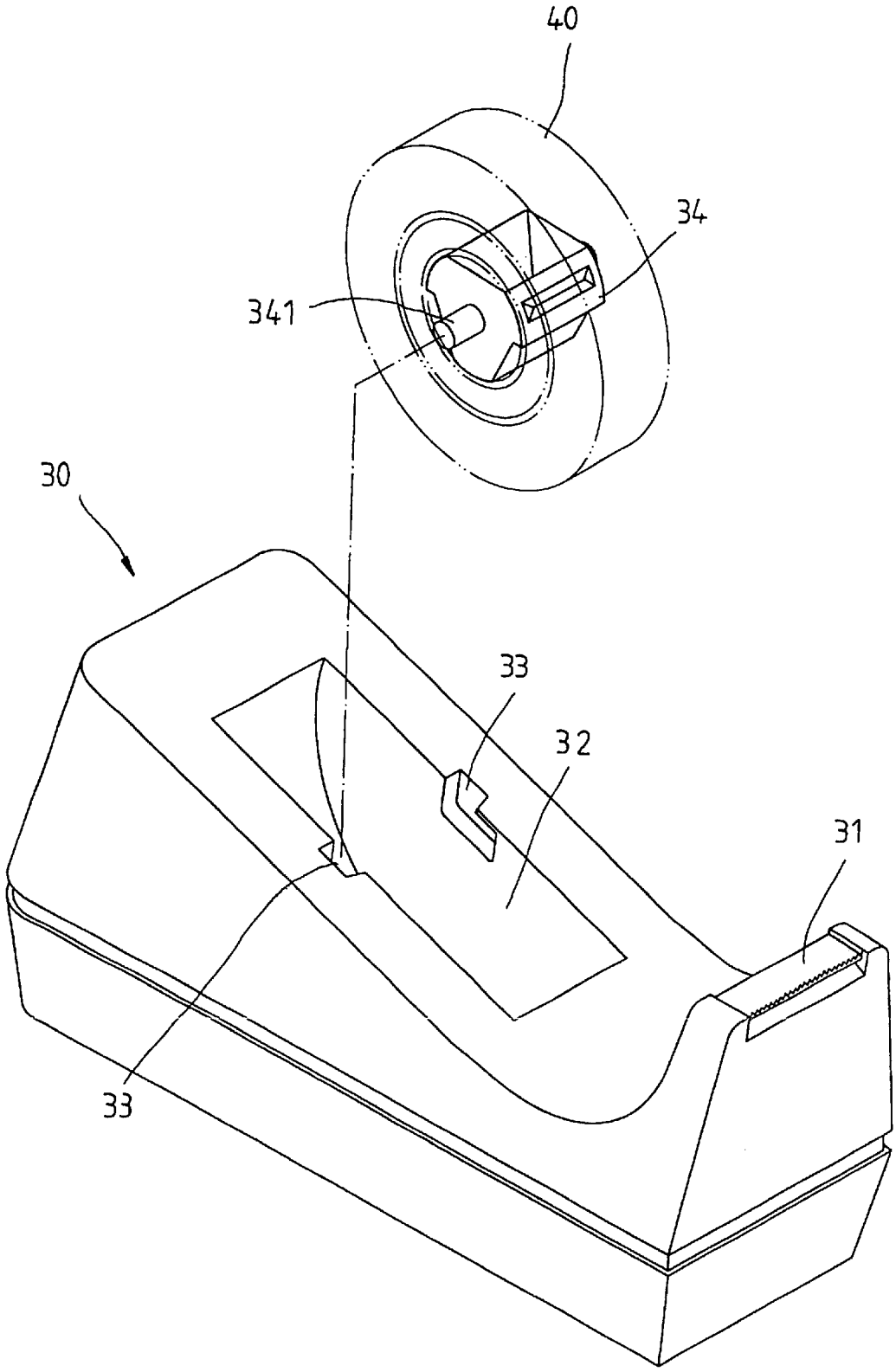
FIG.1 PRIOR ART
FIG. 1 shows a structural schematic view of a prior art tape dispenser.
Figure 2:
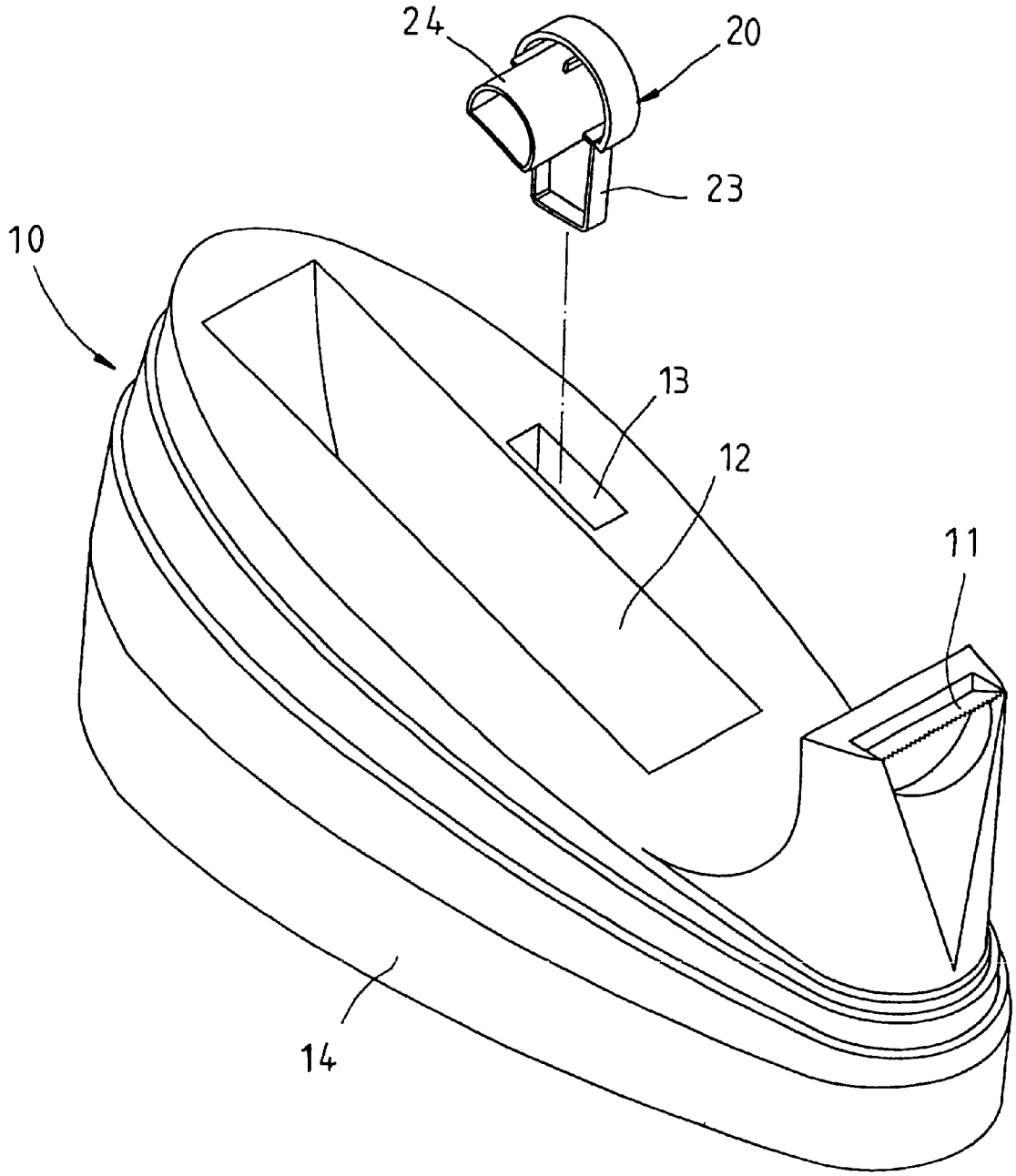
FIG. 2 shows a perspective view of the pre-assembly of a preferred embodiment of the present invention to show the connection relationship between the tape reel set and the seat body.

As shown in all drawings, the embodiment of the present invention comprises the following components.

A seat body 10 is a long shell body and is provided in the front end of the top with a cutter 11, and in the top with a long groove 12 and a joining hole 13 which is a rectangular recessed slot neighbored at one side of the long groove 12. The seat body 10 is provided at the bottom with a bottom seat 14 which is provided therein with a heavy object, such as iron sand (shown in the drawing), for stabilizing the seat body 10 on a surface.

A tape reel seat 20 is provided at the bottom with an insertion portion 23 of a rectangular rod body, and at the top with a mounting portion 24 extending horizontally to form a hollow pillar body with a semicircular cross section for mounting rotatably thereon a tape roll 40 having a smaller cylindrical diameter.

Figure 3:
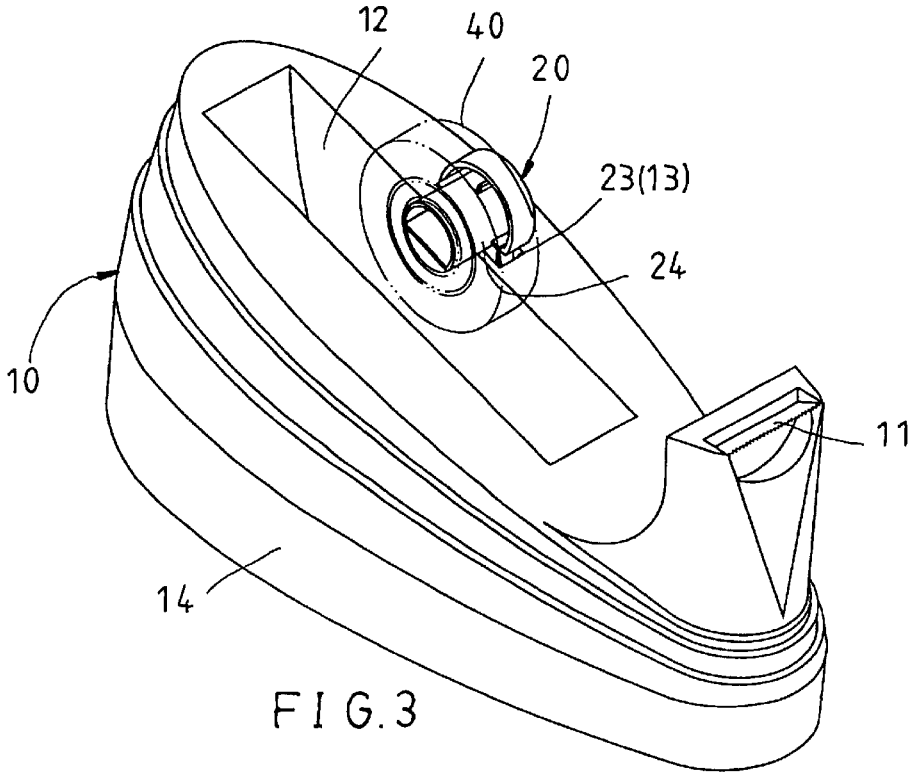
FIG. 3 is a continuity of FIG. 2 for showing the perspective view of the post-assembly.

As shown in FIG. 3, the insertion portion 23 of the tape reel seat 20 is inserted joining hole 13 of the seat body 10 such that they are in the state of interference fit, and that the tape reel seat 20 is securely confined on the seat body 10. In the meantime, the mounting portion 24 is located over the groove, 12 of the sea body 10, so as to enable the bottom side of the tape roll 40 to be located in the groove 12 to prevent the escape of the tape roll 40.

The tape roll 40 is replaced or mounted by removing upwards the tape reel seat 20 from the joining hole 13 of the seat body 10.

Figure 5:
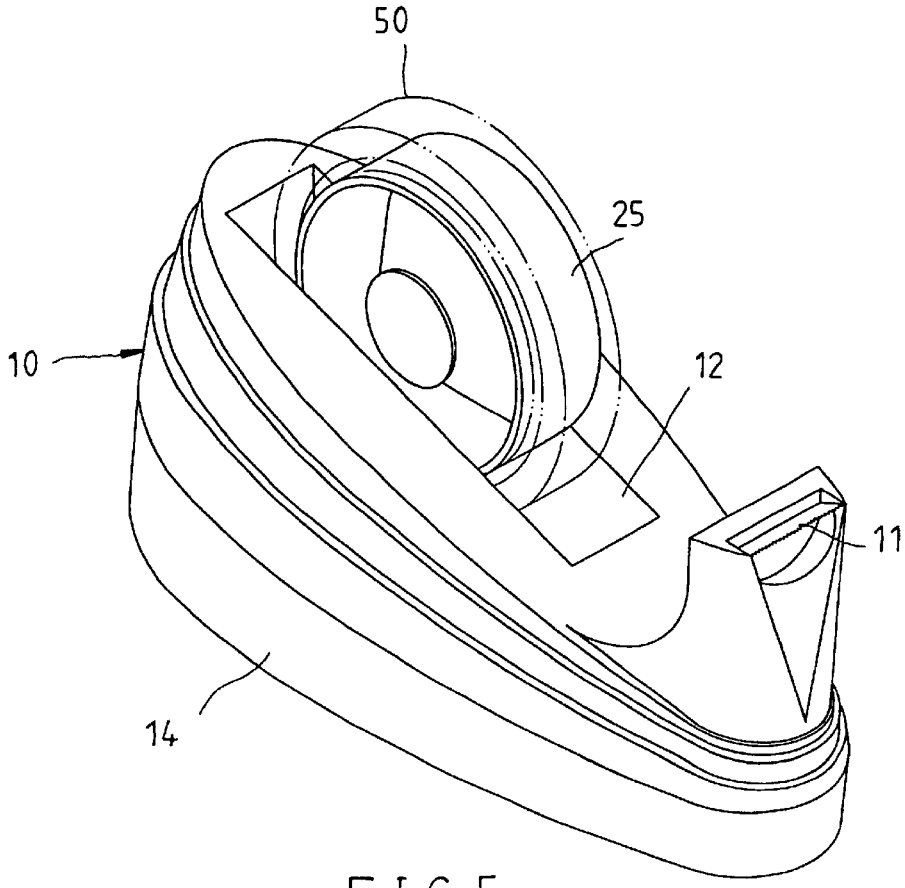
FIG. 5 is a continuity of FIG. 4 to show the post-assembly perspective view.
Figure 4:
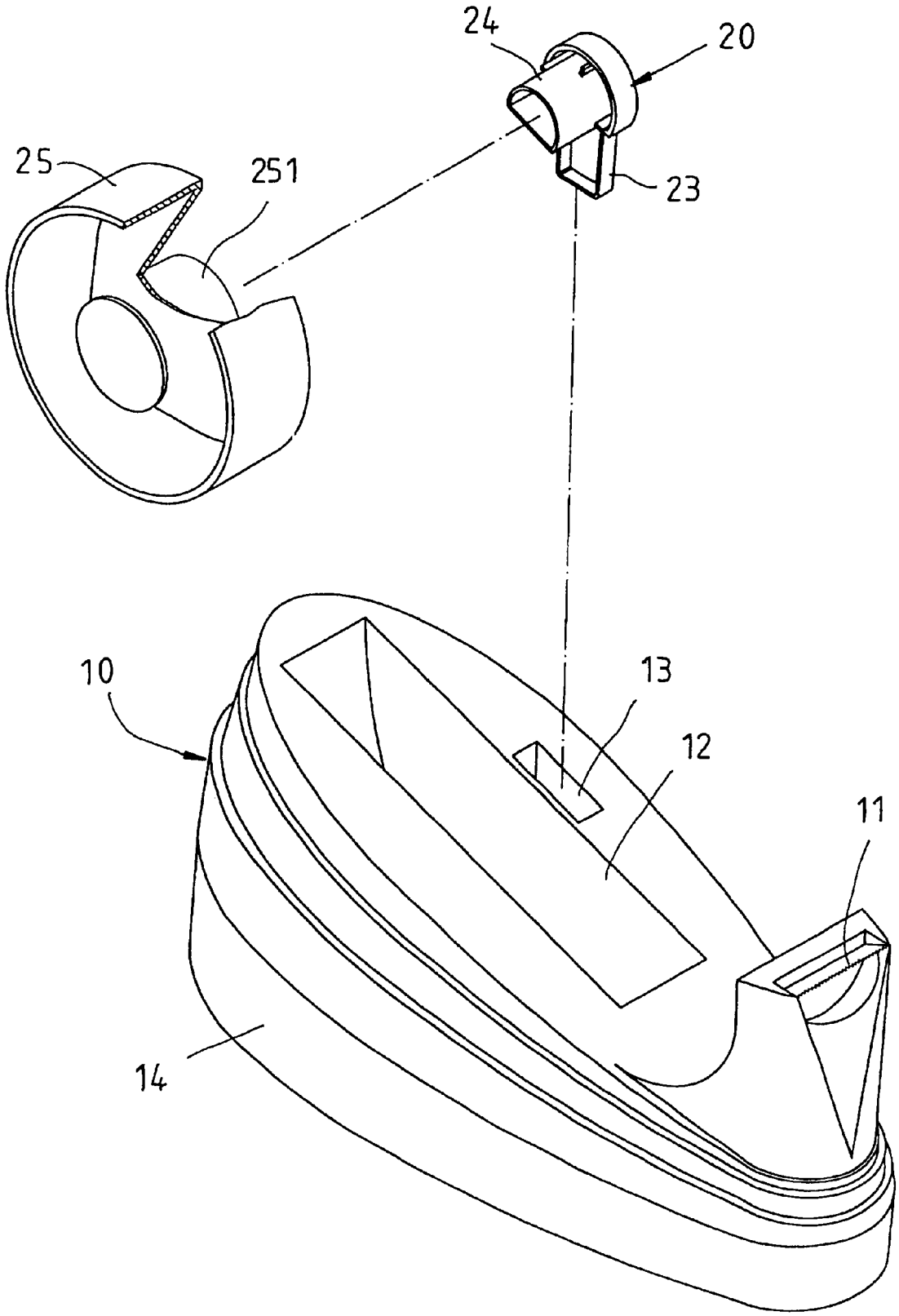
FIG. 4 is a perspective view of the pre-assembly of the preferred embodiment of the present invention to show the connection relationship among the tape reel seat, the mounting seat and the seat body.

As shown in FIG. 4, the embodiment of the present invention further comprises a mounting seat 25, which is a round disk body to facilitate the mounting of a tape roll 50 of a greater diameter. The mounting seat 25 is provided at the center of one side with a joining portion 251, which is a hollow columnar body with an inner diameter slightly greater than the mounting portion 24 of the tape reel seat 20, thereby enabling the joining portion 251 of the mounting seat 25 to join with the tape reel seat 20 in conjunction with the mounting portion 24. The joining portion 251 and the mounting portion 24 are in a loose-fitting state, so as to enable the mounting seat 25 to turn freely. Now referring to FIG. 5, the tape reel seat 20 is once again joined with the seat body 10 by the method described above such that the bottom side of the mounting seat 25 is received in the groove 12 of the seat body 10 to prevent the escape of the mounting seat 25. The dispenser of the present invention is thus capable of accommodating a tape roll 50 of a greater diameter.

The present invention has advantages. First, the present invention is simple in construction. Second, the present invention comprises a tape reel seat which has a greater confining and fixing force to prevent the escape of the tape reel seat in the event that the seat body is tilted or put upside down. The tape reel seat is thus prevented from being divorced from the seat body. In addition, the tape reel seat can be removably mounted with ease and speed.

What is claimed is:

1. A tape dispenser comprising:

a seat body provided at the front end thereof with a tape cutter, in the top thereof with a long groove and a joining hole spaced apart from said long groove at one side of said groove, said seat body further provided at the bottom thereof with a bottom seat having a greater weight to stabilize said seat body on a surface;

a tape reel seat provided at one end thereof with an insertion portion, and at other end thereof with a mounting portion for mounting a tape roll, said insertion portion is inserted into said joining hole of said seat body such that said tape reel seat being removably confined on said seat body; and a mounting seat which is removably mounted on said tape reel seat, said mounting seat being used for mounting thereon a tape roll.

2. The tape dispenser as defined in claim 1, wherein said mounting seat has a joining portion to enable said mounting seat to join with said mounting portion such that said mounting seat is joined with said tape reel seat.

3. The tape dispenser as defined in claim 2, wherein said joining portion of said mounting seat is joined with said mounting portion of said tape reel seat in a loose-fitting state.

4. The tape dispenser as defined in claim 3, wherein said mounting seat has a portion which is received in said groove of said seat body.

5. The tape dispenser as defined in claim 1, wherein said mounting portion of said tape reel seat is a columnar body extending sideways to enable said mounting portion to be slightly located over said groove of said seat body at the time when said tape reel seat is mounted on said seat body.

6. The tape dispenser as defined in claim 1, wherein said insertion portion of said tape reel seat is a columnar body corresponding in shape to said joining hole of said seat body, said insertion portion being joined with said joining hole in an interference fit.

7. A tape dispenser comprising:

a seat body provided at the front end thereof with a tape cutter, in the top thereof with a long groove and a joining hole spaced apart from said long groove at one side of said groove, said seat body further provided at the bottom thereof with a bottom seat having a greater weight to stabilize said seat body on a surface; and a tape reel seat provided at one end thereof with an insertion portion, and at other end thereof with a mounting portion for mounting a tape roll, said insertion portion being removably fixed in said joining hole of said seat body such that said tape reel seat is confined on said seat body.

8. The tape dispenser as defined in claim 7, further comprising a mounting seat which is removably mounted on said tape reel seat, said mounting seat being used for mounting thereon a tape roll.

9. The tape dispenser as defined in claim 8, wherein said mounting seat has a joining portion to enable said mounting seat to join with said mounting portion such that said mounting seat is joined with said tape reel seat.

10. The tape dispenser as defined in claim 9, wherein said joining portion of said mounting seat is joined with said mounting portion of said tape reel seat in a loose-fitting state.

11. The tape dispenser as defined in claim, wherein said mounting seat has a portion which is received in said groove of said seat body.

12. The tape dispenser as defined in claim 7, wherein said mounting portion of said tape reel seat is a columnar body extending sideways to enable said mounting portion to be slightly located over said groove of said seat body at the time when said tape reel seat is mounted on said seat body.

13. The tape dispenser as defined in claim 7, wherein said insertion portion of said tape reel seat is a columnar body corresponding in shape to said joining hole of said seat body, said insertion portion being joined with said joining hole in an interference fit.

14. The tape dispenser as defined in claim 7, wherein the mounting portion extends away from the insertion portion and above the long groove when the tape reel seat is fixed in the joining hole to dispense a tape roll.

* * * * *